US005396308A

United States Patent [19]

Shimamoto et al.

[11] Patent Number: 5,396,308

[45] Date of Patent: Mar. 7, 1995

[54] FEED RACK FOR FEEDING PHOTOSENSITIVE MATERIALS

[75] Inventors: Yoshinori Shimamoto; Masayuki Nakanishi, both of Wakayama, Japan

[73] Assignee: Noritsu Koki Co., Ltd., Wakayama, Japan

[21] Appl. No.: 186,620

[22] Filed: Jan. 26, 1994

[30] Foreign Application Priority Data

Jan. 27, 1993 [JP] Japan ..... 5-011445
Feb. 16, 1993 [JP] Japan ..... 5-026877

[51] Int. Cl.[6] ..... G03D 3/08
[52] U.S. Cl. ..... 354/319
[58] Field of Search ..... 354/319-323, 354/339, 340; 134/64 P, 122 P

[56] References Cited

U.S. PATENT DOCUMENTS 5,134,430 7/1992 Koizumi ..... 354/320

*Primary Examiner*—D. Rutledge
*Attorney, Agent, or Firm*—Wenderoth, Lind & Ponack

[57] ABSTRACT

There is provided an improved rack for feeding photosensitive materials, which is so adapted that an operator can turn its feed rollers without soiling his hand. A vertically-extending roller driving shaft is rotatably provided outside of a rack body. A sprocket carries a bevel gear which is coaxial with the sprocket and meshes with a bevel gear fixed to the top end of the roller driving shaft. The bevel gear mounted on the sprocket has a cylindrical member. Outside of the cylindrical member is provided a knob. A spring is mounted to bias the knob away from the sprocket. The knob has a control sleeve which can be moved to a position where it surrounds the sprocket. After moving the control sleeve to this position, the knob is turned by hand to turn the roller driving shaft.

12 Claims, 8 Drawing Sheets

FEED RACK FOR FEEDING PHOTOSENSITIVE MATERIALS

BACKGROUND OF INVENTION

This invention relates to a feed rack for feeding photosensitive materials in treating tanks such as a developing tank in an automatic developing machine.

Ordinarily, a feed rack is suspended in each of various treating tanks in an automatic developing machine for developing photosensitive materials to feed the photosensitive materials.

FIGS. 5-9 show one of such conventional feed rack. It comprises a rack body 1, a pair of rack plates 1*a*, 1*b* provided on both sides of the rack body 1, a pair of feed rollers 2 and a pair of delivery rollers 3 that are arranged between the upper portions of the rack plates 1*a*, 1*b*, a turn roller 4 provided between the lower portions of the rack plates la, 1*b*, and a plurality of presser rollers 5 arranged around the turn roller 4. A photosensitive material A, held between the pair of feed rollers 2, is fed downwards, guided around the turn roller 4 and then fed upwards. It is then discharged by the pair of delivery rollers 3.

A pair of width guides 6 are provided on both sides of the downward path of the photosensitive material A extending from the feed rollers 2 to the turn roller 4 and its upward path from the turn roller 4 to the delivery rollers 3 to guide the movement of the side edges of the photosensitive material A.

Outside of one of the pair of rack plates 1*a*, 1*b*, there are provided a driving wheel 7 in the form of a sprocket and a torque transmission wheel 8 in the form of a bevel gear which is coaxial with the driving wheel 7. When the rack body is hanged in an unillustrated treating tank, the driving wheel 7 engages a chain 9 provided in the upper part of the treating tank at one side. By driving the chain 9, the driving wheel 7 and thus the torque transmission wheel 8 are rotated. The rotation of the wheel 8 is transmitted to various rollers 2, 3, 4 and 5 through a torque transmission mechanism 10.

The mechanism 10 has a roller driving shaft 11 rotatably mounted outside of one of the rack plates 1*a*, and a bevel gear 12 mounted on the roller driving shaft 11 and meshing with the torque transmission wheel 8. The torque transmitted from the wheel 8 to the roller driving shaft 11 is transmitted through a pair of bevel gears 13*a*, 13*b* to an intermediate shaft 14 and then through a mutually meshing spur gears 15*a*, 15*b* to the feed rollers 2 and the delivery rollers 3.

The rotation of the roller driving shaft 11 is also transmitted through mutually meshing bevel gears 16*a*, 16*b* to a roller shaft 4*a* of the turn roller 4 and then through mutually meshing spur gears 17*a*, 17*b* to the presser rollers 5.

If a photosensitive material A gets stuck in the rack body 1 or for maintenance of the rack such as when cleaning the rack, the rack body 1 has to be raised out of the developing tank to turn the respective rollers 2, 3, 4 and 5 in this state.

In order to turn the rollers 2, 3, 4 and 5, the driving wheel 7, which is covered with lubricants such as grease, has to be turned by hand, so that the hand tends to be soiled with lubricants. Furthermore, an operator will feel pain in the hand when turning the driving wheel because he has to touch its teeth.

The intermediate shaft 14 and the roller shaft 4*a* of the turn roller 4 carry two each gears, i.e. bevel gears 13*a*, 16*b*and spur gears 15*b*, 17*b*. Thus, the torque transmission mechanism 10 comprises so many parts and thus is bulky and requires a long time to assemble. Moreover, its dimensional accuracy after assembled tends to be low.

SUMMARY OF THE INVENTION

An object of this invention is to provide a feed rack which allows an operator to turn the rollers in the rack body without soiling his hands and which is small both in the entire size and the number of parts of its torque transmission mechanism.

According to this invention, there is provided a rack for feeding photosensitive materials comprising a rack body, a pair of rack plates secured to the rack body, rollers provided between the pair of rack plates for feeding photosensitive materials, a driving wheel provided outside of one of the rack plates, a torque transmission wheel mounted to be coaxial with and rotatable together with the driving wheel, a torque transmission means for transmitting the rotation of the torque transmission wheel to the rollers, the torque transmission wheel having a guide sleeve, a control sleeve mounted on the guide sleeve so as to be unrotatable and slidable between a first position where it surrounds the driving wheel and a second position where it is away from the driving wheel, and an engaging means for preventing axial movement of the control shaft when it is in the first position.

In order to rotate the rollers in the rack body, the rack body is raised up from a treating tank. In this state, after sliding the control sleeve axially to the position where it surrounds the driving wheel and locking it in this position, the control sleeve is gripped and turned. The rotation of the control sleeve is transmitted through the torque transmission wheel and the torque transmission mechanism to the rollers in the rack body. Thus, the rollers can be turned easily by hand without soiling the hand.

Moreover, since the rollers are rotated by gripping and turning the control sleeve, which is larger in outer diameter than the driving wheel, they can be turned with less turning torque without the operator feeling any pain in his hand.

The knob can be moved pretty easily to the position for turning it by hand simply by pulling the knob toward the driving wheel, turning it until its protrusions are directly opposite to the first engaging grooves, and releasing it to allow it to move axially to the position where the protrusions abut the closed ends of the first engaging grooves.

Each bevel gear for driving the corresponding roller has a cylindrical surface on which are formed numerous annularly arranged teeth so that it also has a function as a spur gear. Thus, there is no need to separately provide spur gears in order to drive various rollers. The torque transmission mechanism according to this invention is thus made up of fewer parts, so that it is small in size and can be assembled easily.

Other features and objects of the present invention will become apparent from the following description made with reference to the accompanying drawings, in which:

DETAILED DESCRIPTION OF THE INVENTION

Referring to FIGS. 1–4, the feed rack of the embodiment has generally the same structure as the one shown in FIGS. 5–9. Thus, these figures are sometimes referred to in the following description.

Figure 1:
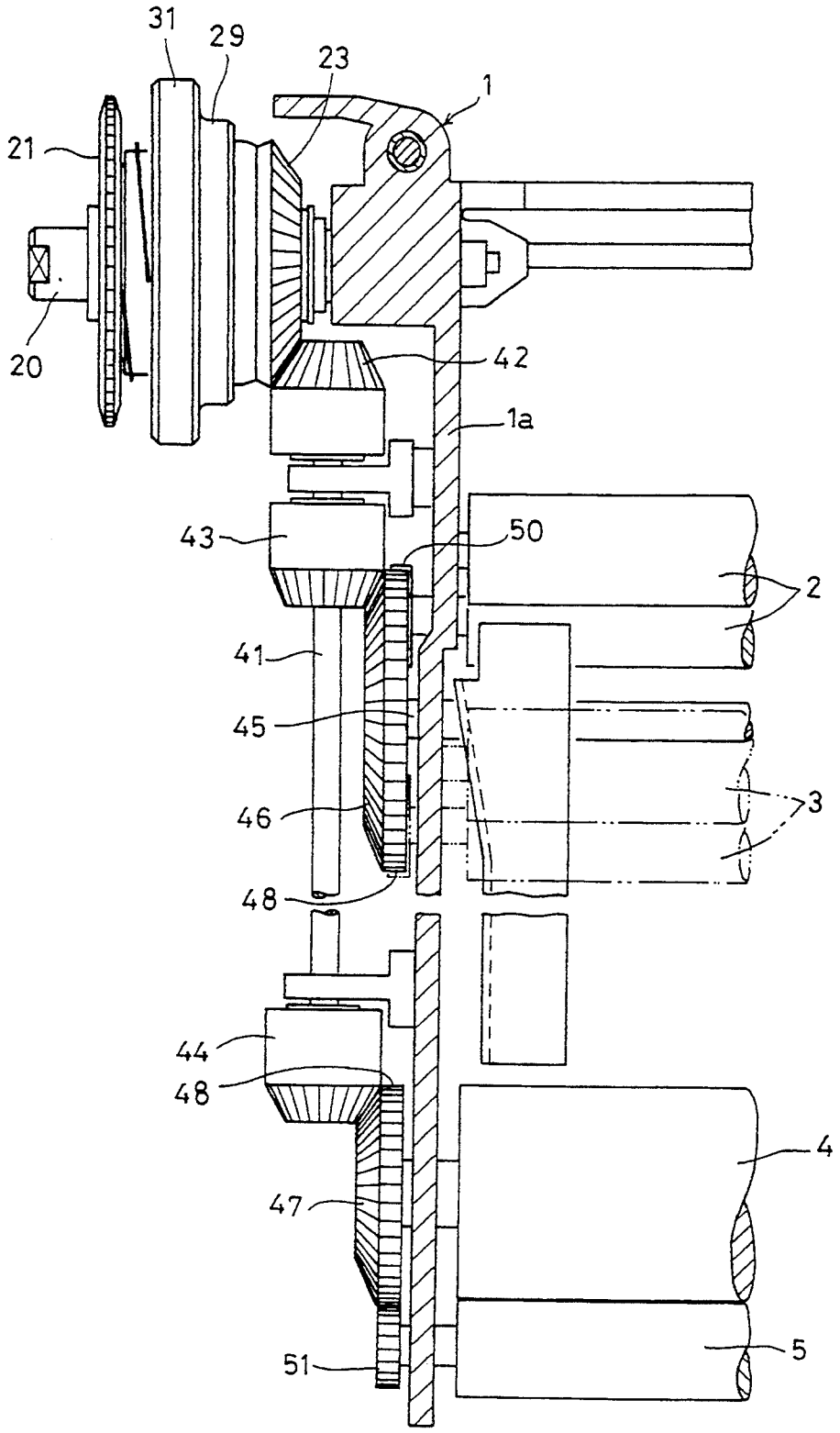
FIG. 1 is a vertical sectional front view showing only a portion of the feed rack according to this invention.
Figure 2:
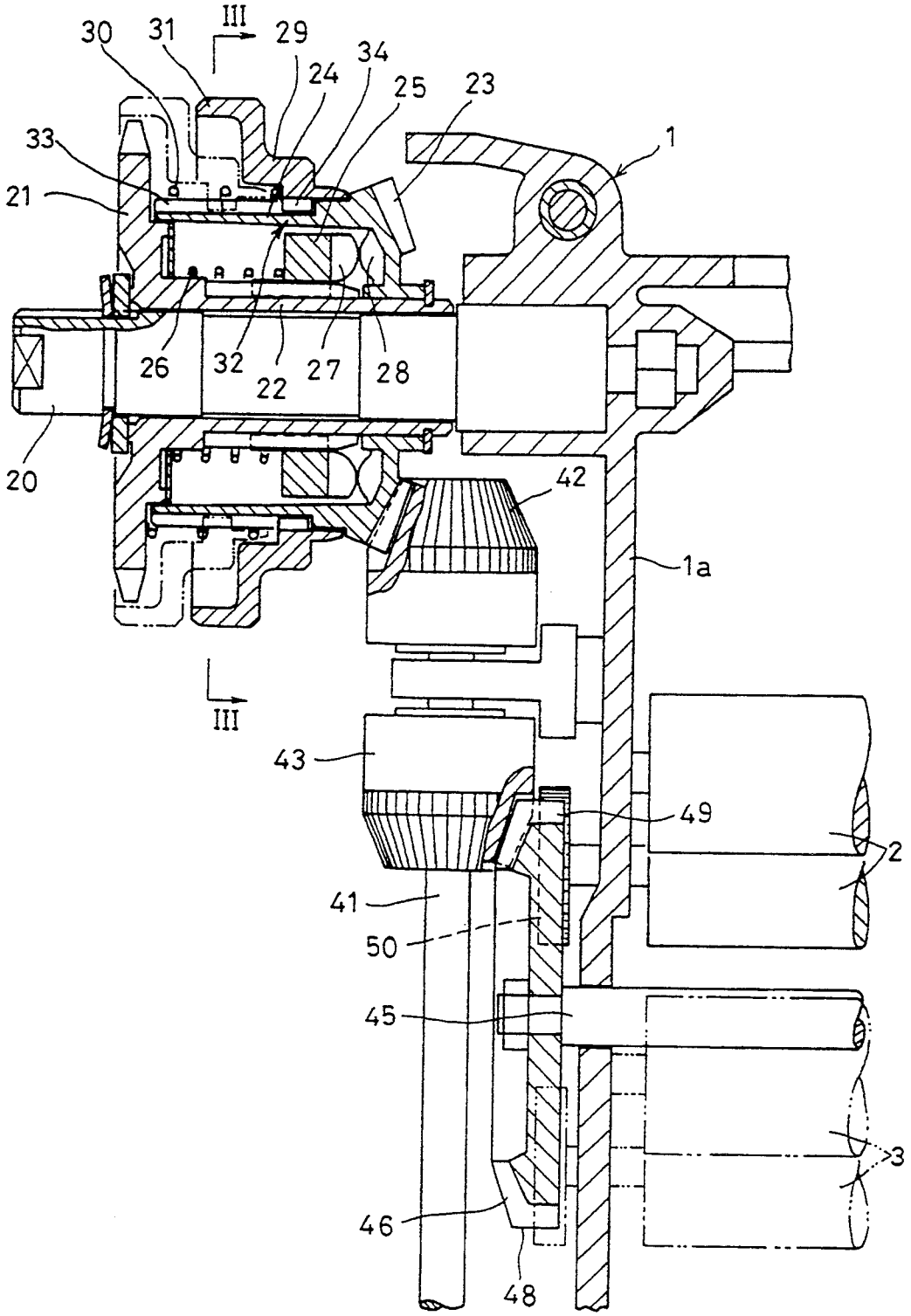
FIG. 2 is an enlarged sectional view of the same.
Figure 3:
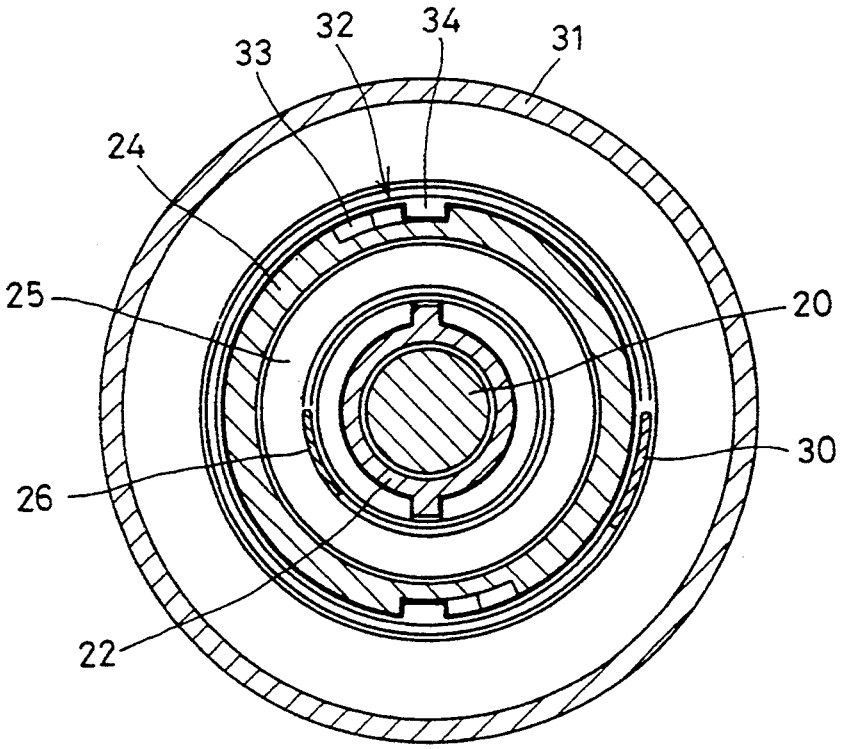
FIG. 3 is a sectional view taken along line III—III of FIG. 1.

As shown in FIGS. 1 and 2, a driving wheel 21 in the form of a sprocket is rotatably supported on a support shaft 20 protruding from one of the rack plates la.

Figure 5:
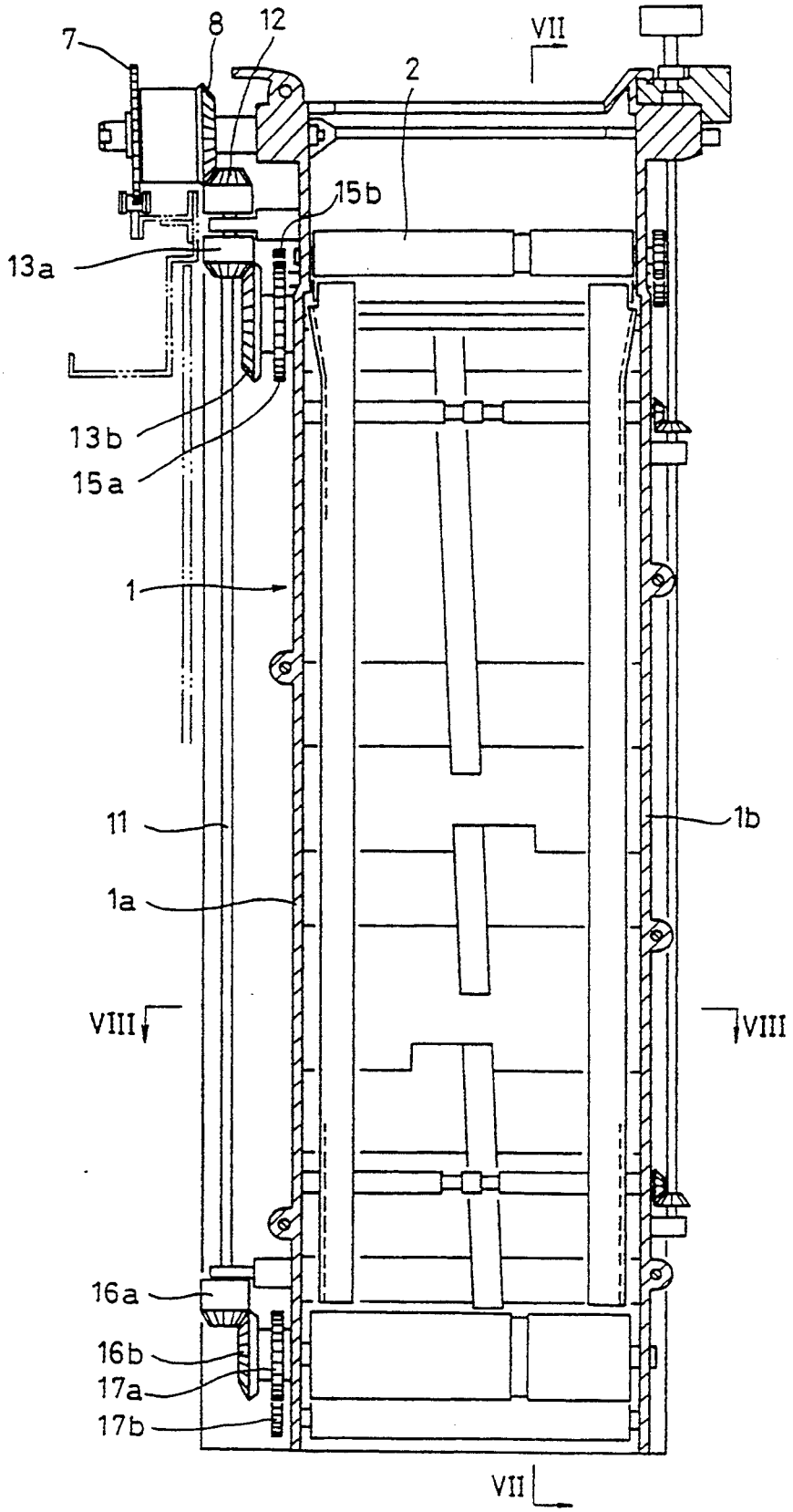
FIG. 5 PRIOR ART
FIG. 5 is a vertical sectional front view of a conventional feed rack.
Figure 6:
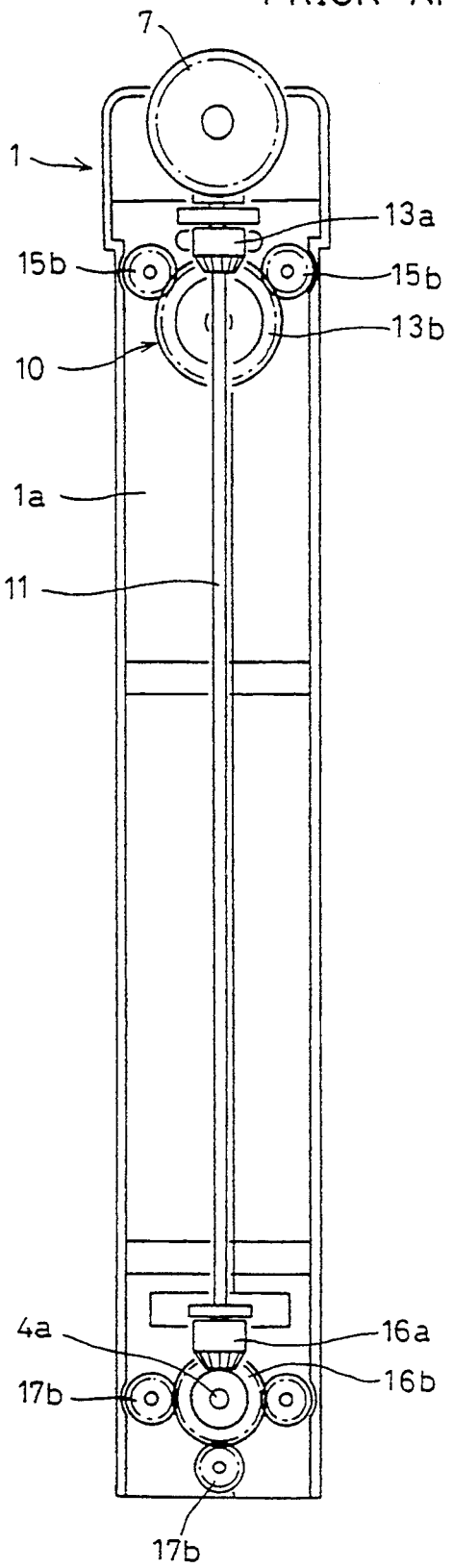
FIG. 6 PRIOR ART
FIG. 6 is a side view of FIG. 5.

By hanging the rack body 1 in the treating tank, the driving wheel 21 engages the chain as shown in FIG. 5 and is rotated by driving the chain 9. The driving wheel 21 has a boss portion 22 on which is rotatably supported a torque transmission wheel 23 in the form of a bevel gear.

The torque transmission wheel 23 has a guide sleeve 24 surrounding the boss portion 22. Inside the guide sleeve 24 are mounted a torque transmission plate 25 and a spring 26 biasing the plate 25 against a closed end of the guide sleeve 24.

The torque transmission plate 25 is unrotatable with respect to the boss portion 22 and is provided on its end facing the closed end of the guide sleeve. 24 with a plurality of semispherical protrusions 27 arranged at angular intervals. The protrusions 27 are in engagement with semispherical protrusions 28 provided on the closed end of the guide sleeve 24, so that the rotation of the driving wheel 21 is transmitted to the transmission wheel 23. However, if an excessive load is exerted on the transmission wheel 23, the protrusions 27 and 28 slip relative to each other, thus cutting off torque transmission to the transmission wheel 23.

The guide sleeve 24 of the transmission wheel 23 may be fixed to the driving wheel 21 instead of interposing the torque transmission plate 25 therebetween.

Outside the guide sleeve 24 are mounted a cylindrical knob 29 and a spring 30 biasing the knob 29 away from the driving wheel 21.

The knob 29 has a control sleeve 31 having an inner diameter larger than the outer diameter of the driving wheel 21. The knob 29 can be moved to a position where its control sleeve 31 surrounds the sprocket 7. In this position, the knob 29 is prevented by engaging means 32 from moving axially and from rotating relative to the guide sleeve 24.

The engaging means 32 comprises guide grooves 33 formed in the outer periphery of the guide sleeve 24 and protrusions 34-formed on the inner periphery of the knob 29 and slidably inserted in the guide grooves 33.

Figure 4:
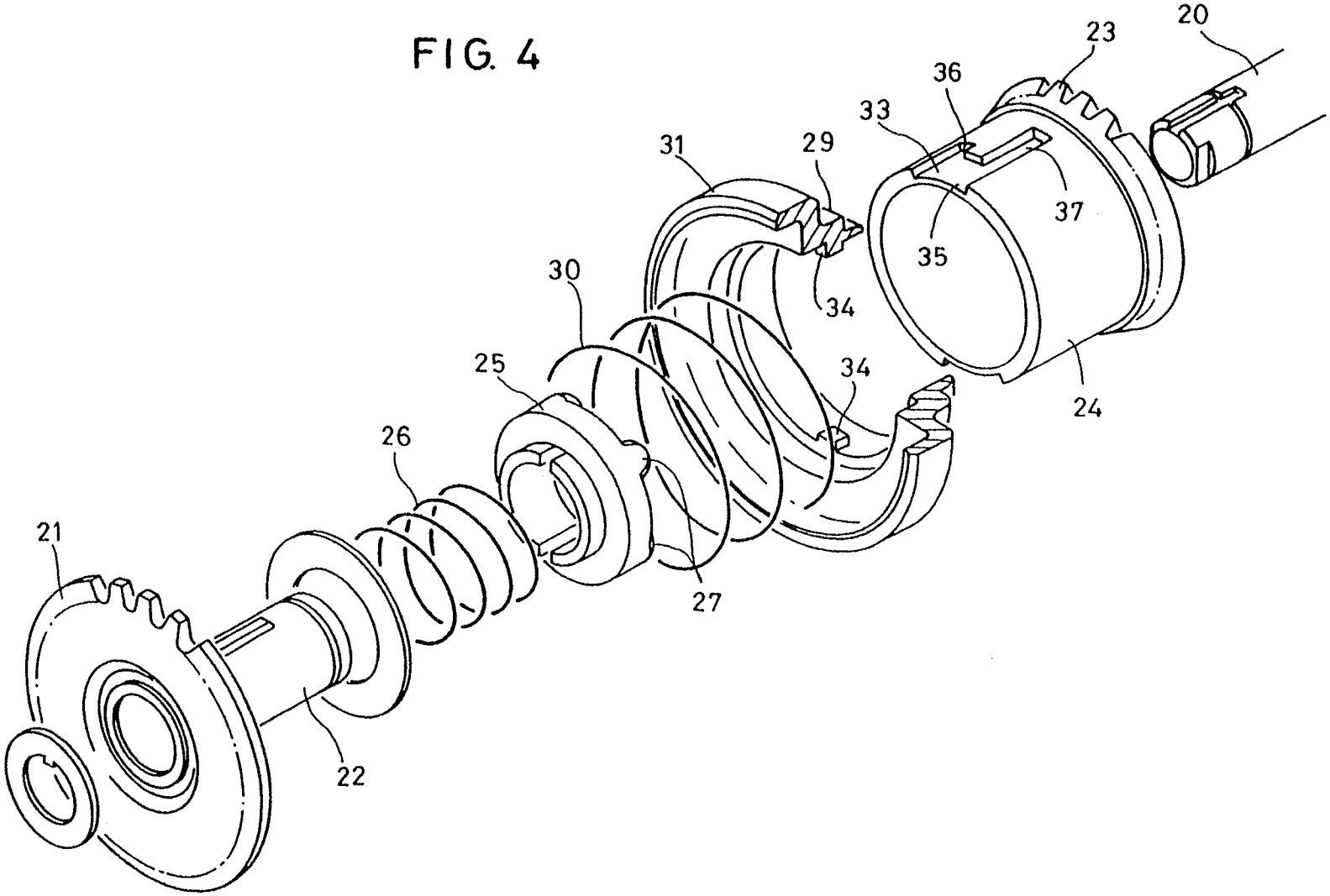
FIG. 4 is an exploded perspective view of the same.

Each guide groove 33 comprises a circumferential groove 35 and first and second engaging grooves 36, 37 that extend axially from both ends of the circumferential groove 35 (FIG. 4). The first engaging groove 36 is shorter than the second engaging groove 37. By bringing each protrusion 34 into engagement with the closed end of the first engaging groove 36, the knob 29 is held in the position where the control sleeve 31 surrounds the driving wheel 21. By bringing each protrusion 34 into engagement with the closed end of the second engaging groove 37, the knob 29 is held in the position where its control sleeve 31 is located apart from the driving wheel 21.

The rotation of the torque transmission wheel 23 is transmitted through a torque transmission mechanism 40 to the rollers 2, 3, 4 and 5 mounted in the rack body 1.

The torque transmission mechanism 40 has a vertically extending roller driving shaft 41 rotatably mounted outside the rack plate 1*a*. A bevel gear 42 is secured to the top end of the roller driving shaft 41 so as to mesh with the torque transmission wheel 23. The rotation of the wheel 23 is thus transmitted to the roller driving shaft 41 through the bevel gear 42.

Further, bevel gears 43 and 44 are secured to the top and bottom ends of the roller driving shaft 41. Bevel gears 46 and 47 are secured to an intermediate shaft 45 rotatably supported on the rack plate la and the roller shaft 4*a* of the turn roller 4, respectively, so as to mesh with the bevel gears 43 and 44. The rotation of the roller driving shaft 41 is thus transmitted to the intermediate shaft 45 and the roller shaft 4*a* of the turn roller 4.

The bevel gears 46, 47 have cylindrical outer peripheral surfaces 48 on which are formed numerous teeth 49. The teeth 49 formed on the cylindrical outer surface of the bevel gear 46, which is mounted on the intermediate shaft 45, mesh with spur gears 50 mounted on the roller shafts of the feed rollers 2 and those of the delivery rollers 3, so that the rotation of the bevel gear 46 is transmitted to the feed rollers 2 and the delivery rollers 3.

The teeth 49 formed on the cylindrical outer surface of the bevel gear 47, which is mounted on the roller shaft 4*a* of the turn roller 4, are in meshing engagement with a spur gear 51 mounted on the roller shaft of the presser roller 5. The rotation of the bevel gear 47 is thus transmitted to the presser roller 5.

Figure 9:
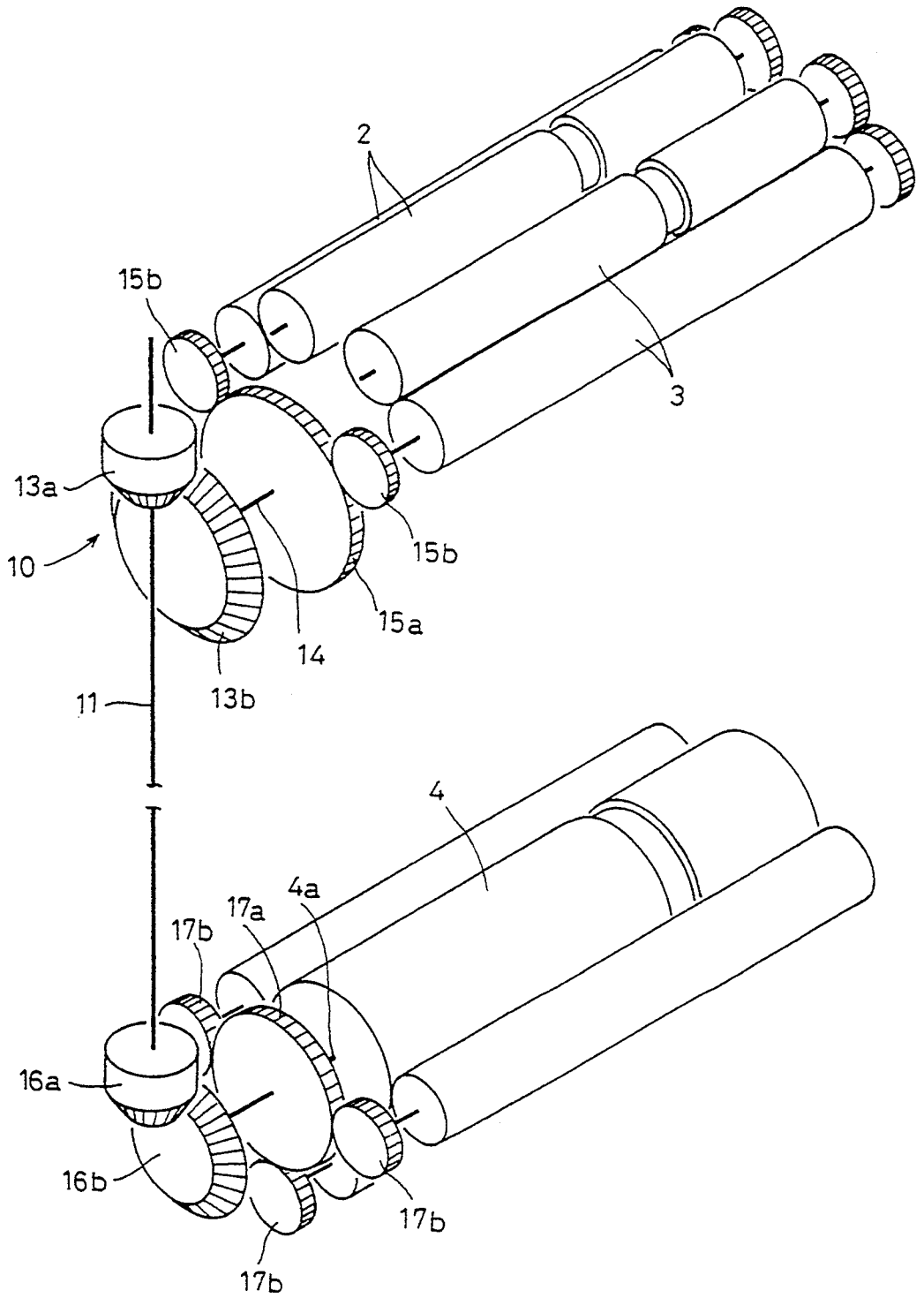
FIG. 9 PRIOR ART
FIG. 9 is a perspective view of the torque transmission mechanism of the same.

As described above, since the bevel gears 46, 47 have the function as spur gears, there is no need to separately provide the spur gears 15*a*, 15*b* shown in FIG. 9. This makes it possible to reduce the number of parts forming the torque transmission mechanism 40, so that it can be assembled easily and its size can be reduced.

Figure 7:
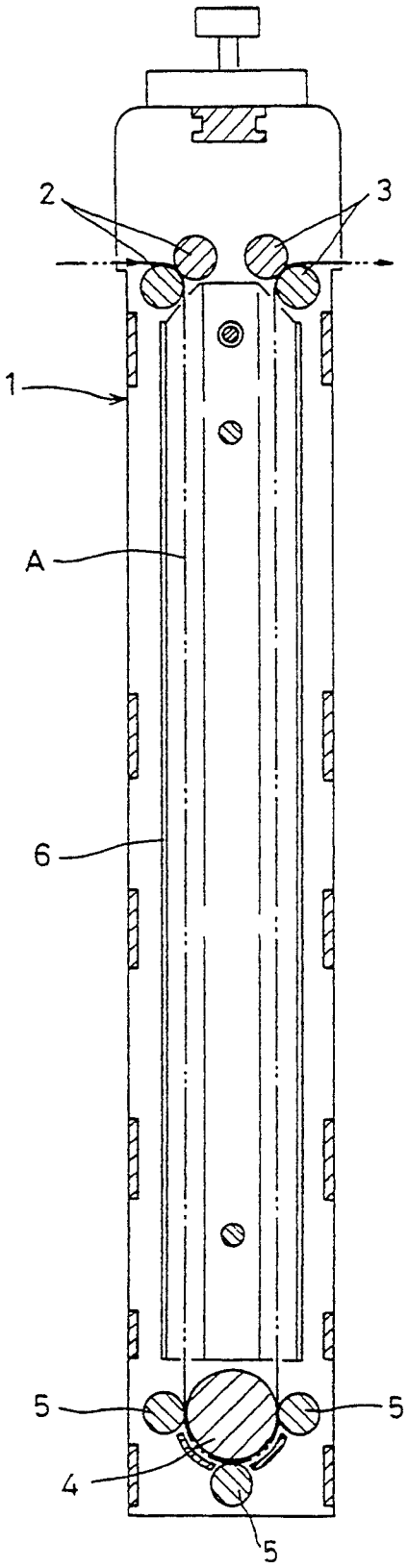
FIG. 7 PRIOR ART
FIG. 7 is a sectional view taken along line VII—VII of FIG. 5.
Figure 8:
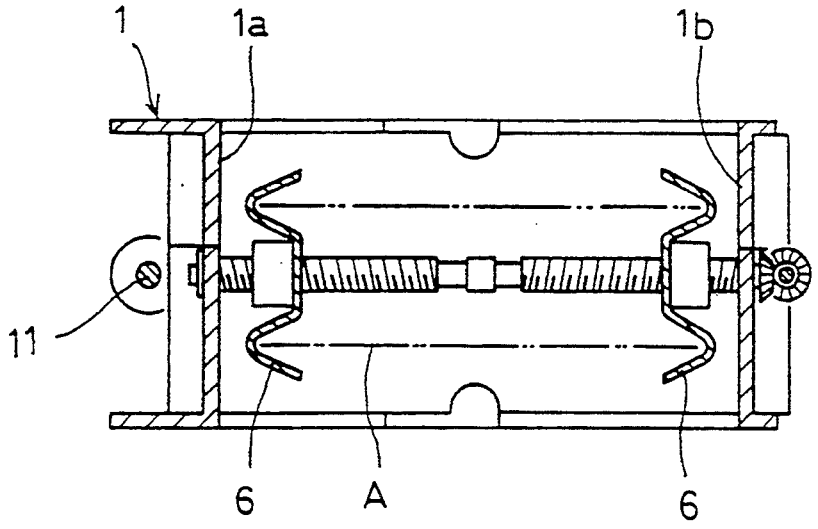
FIG. 8 PRIOR ART
FIG. 8 is a sectional view taken along line VIII—VIII of FIG. 5.

In order to set the feed rack in a treating tank, the rack body 1 is hang in the treating tank with the control sleeve 31 of the knob 29 kept apart from the driving wheel 21 by keeping the protrusions 34 in engagement with the closed ends of the second engaging grooves 37. Thus, the driving wheel 21 will engage the chain 9 as shown in FIG. 5. By driving the chain 9 in this state, the driving wheel 21 can be turned. The rotation of the driving wheel 21 is transmitted through the torque transmission wheel 23 and the bevel gear to the roller driving shaft 41 and then to the respective rollers 2, 3, 4 and 5 mounted in the rack body 1 (FIG. 7). Photosensitive materials are thus fed in the tank.

If a photosensitive material gets stuck in the rack body or when maintenance or cleaning of the rack is necessary, the rack body 1 has to be raised out of the treating tank and turn the respective rollers by hand in this state.

In order to turn the rollers by hand, the knob 29 is pulled until its control sleeve 31 slides to the position 7here it surrounds the driving wheel 21 and each protrusion 34 is in the circumferential groove 35; then turned until each protrusion 34 is moved to the first engaging groove 36; released to allow it to move axially by the force of the spring 30 until each protrusion 34 engages the closed end of the first engaging groove 36; and finally the knob 29 is turned by gripping the control sleeve 31.

In this state, the driving wheel 21 is completely covered by the control sleeve 31. Thus, the operator's hand will never touch the driving wheel 21 when turning the control sleeve 31. His hand is thus kept clean. By turning the control sleeve 31, its rotation is transmitted through the engagement between the first grooves 36 and the protrusions 34 to the guide sleeve 24 and then through the wheel 23 and the bevel gear 42 and the roller driving shaft 41 to the respective rollers 2, 3, 4 and 5.

In the embodiment, the control sleeve 31 is moved to its engaging position by utilizing the force of the spring 30. Instead of the spring, magnets having the same polarity may be mounted on the opposite surfaces of the control sleeve 31 and the driving wheel 21 to move the control sleeve 31 away from the driving wheel 21.

Otherwise, magnets having different polarities may be mounted on the closed ends of the first and second engaging grooves 36 and 37 and the protrusions 34 to move the control sleeve 31 between the position where it is away from the driving wheel 21 and the position where it covers the driving wheel and hold it in the respective positions.

What is claimed is:

1. A rack fur feeding photosensitive materials comprising a rack body, a pair of rack plates secured to the rack body, rollers provided between said pair of rack plates for feeding photosensitive materials, a driving wheel provided outside of one of said rack plates, a torque transmission wheel mounted to be coaxial with and rotatable together with said driving wheel, a torque transmission means for transmitting the rotation of said torque transmission wheel to said rollers, said torque transmission wheel having a guide sleeve, a control sleeve mounted on said guide sleeve so as to be unrotatable and slidable between a first position where it surrounds said driving wheel and a second position where it is away from said driving wheel, and an engaging means for preventing axial movement of said control shaft when it is in said first position.

2. A rack for feeding photosensitive materials as claimed in claim 1 further comprising a biasing means for biasing said control sleeve in a direction away from said driving wheel.

3. A rack for feeding photosensitive materials as claimed in claim 1 wherein said engaging means comprises a guide groove formed in the outer peripheral surface of said guide sleeve and a protrusion formed on the inner peripheral surface of said control sleeve so as to be inserted in said guide groove, said guide groove comprising a circumferential groove and first and second engaging grooves that extend axially in the same direction from both ends of said circumferential groove, said first engaging groove being of such an axial length that said control sleeve is disposed around said driving wheel when said protrusion is in abutment with the closed end of said first engaging groove.

4. A rack for feeding photosensitive materials as claimed of claim 1 wherein said torque transmission wheel is a bevel gear, wherein said torque transmission means has a roller driving shaft rotatably mounted outside of said one of said rack plates so as to extend in a direction perpendicular to the axes of said rollers, said roller driving shaft carrying a bevel gear kept in meshing engagement with said bevel gear and a roller driving bevel gear, and wherein each of said rollers carries a bevel gear which meshes with said roller driving bevel gear.

5. A rack for feeding photosensitive materials as claimed in claim 4 wherein said bevel gears carried on said rollers have cylindrical outer peripheral surfaces on which are formed a plurality of teeth at equal intervals.

6. A rack for feeding photosensitive materials as claimed in claim 2 wherein said engaging means comprises a guide groove formed in the outer peripheral surface of said guide sleeve and a protrusion formed on the inner peripheral surface of said control sleeve so as to be inserted in said guide groove, said guide groove comprising a circumferential groove and first and second engaging grooves that extend axially in the same direction from both ends of said circumferential groove, said first engaging groove being of such an axial length that said control sleeve is disposed around said driving wheel when said protrusion is in abutment with the closed end of said first engaging groove.

7. A rack for feeding photosensitive materials as claimed in claim 2 wherein said torque transmission wheel is a bevel gear, wherein said torque transmission means has a roller driving shaft rotatably mounted outside of said one of said rack plates so as to extend in a direction perpendicular to the axes of said rollers, said roller driving shaft carrying a bevel gear kept in meshing engagement with said bevel gear and a roller driving gear, and wherein each of said rollers carries a bevel gear which meshes with said roller driving bevel gear.

8. A rack for feeding photosensitive materials as claimed in claim 3 wherein said torque transmission wheel is a bevel gear, wherein said torque transmission means has a roller driving shaft rotatably mounted outside of said one of said rack plates so as to extend in a direction perpendicular to the axes of said rollers, said roller driving shaft carrying a bevel gear kept in meshing engagement with said bevel gear and a roller driving gear, and wherein each of said rollers carries a bevel gear which meshes with said roller driving bevel gear.

9. A rack for feeding photosensitive materials as claimed in claim 6 wherein said torque transmission wheel is a bevel gear, wherein said torque transmission means has a roller driving shaft rotatably mounted outside of said one of said rack plates so as to extend in a direction perpendicular to the axes of said rollers, said roller driving shaft carrying a bevel gear kept in meshing engagement with said bevel gear and a roller driving gear, and wherein each of said rollers carries a bevel gear which meshes with said roller driving bevel gear.

10. A rack for feeding photosensitive materials as claimed in claim 7 wherein said bevel gears carried on said rollers have cylindrical outer peripheral surfaces on which are formed a plurality of teeth at equal intervals.

11. A rack for feeding photosensitive materials as claimed in claim 8 wherein said bevel gears carried on said rollers have cylindrical outer peripheral surfaces on which are formed a plurality of teeth at equal intervals.

12. A rack for feeding photosensitive materials as claimed in claim 9 wherein said bevel gears carried on said rollers have cylindrical outer peripheral surfaces on which are formed a plurality of teeth at equal intervals.

* * * * *